United States Patent [19]

Schröder

[11] Patent Number: 5,018,250

[45] Date of Patent: May 28, 1991

[54] FASTENING DEVICE FOR NECKLACES

[76] Inventor: Hubert E. Schröder, In den Blumentriften 1, D-3320 Salzgitter 1, Fed. Rep. of Germany

[21] Appl. No.: 476,744

[22] Filed: Feb. 7, 1990

[30] Foreign Application Priority Data

Feb. 13, 1989 [DE] Fed. Rep. of Germany ... 8901609[U]

[51] Int. Cl.[5] ..... A44C 5/00

[52] U.S. Cl. ..... 24/116 A; 24/702; 63/4

[58] Field of Search ..... 24/116 A, 702, 573.1, 24/573.3, 698.1, 698.3; 63/3, 4

[56] References Cited

U.S. PATENT DOCUMENTS

| | | | |
|---|---|---|---|
| 1,337,577 | 4/1920 | Wernimont | 24/698.1 |
| 1,419,644 | 6/1922 | Recker | 24/116 A |
| 1,716,267 | 6/1929 | Gagnon | 24/116 A |
| 3,054,157 | 9/1962 | Evans | 24/116 A |
| 3,224,060 | 12/1965 | Ogden | 24/116 A |
| 3,385,050 | 5/1968 | Hall | 24/116 A X |
| 3,899,802 | 8/1975 | Koehle . | |
| 4,573,243 | 3/1986 | Plaza | 24/116 A |
| 4,745,667 | 5/1988 | Conte | 24/116 A X |

FOREIGN PATENT DOCUMENTS

| | | | |
|---|---|---|---|
| 664395 | 8/1938 | Fed. Rep. of Germany | 24/702 |
| 6804377 | 3/1969 | Fed. Rep. of Germany . | |
| 1905602 | 8/1970 | Fed. Rep. of Germany . | |

*Primary Examiner*—James R. Brittain

*Attorney, Agent, or Firm*—Salter & Michaelson

[57] ABSTRACT

A fastening device for an item of jewelery comprises two parallel rings held apart by spacing elements one of the rings having a slit, whereby a bead-shaped end member can be placed in the rings with its connecting member being passed through the slit. The device may be attached to an eyelet or a further ring pair for the attachment of the other end of a chain of beads.

10 Claims, 2 Drawing Sheets

FASTENING DEVICE FOR NECKLACES

BACKGROUND OF THE INVENTION

The invention relates to a fastening device made of metal for connecting the ends of a jewellery chain or necklace to at least one spherical or pearl-shaped end member which is connected to the chain by means of an intermediate member having a small diameter.

According to U.S. Pat. No. 3,899,802 a fastening device is known for connecting the ends of a necklace, in which a ring is pivotally mounted on the rear face of an annular brooch by means of a hinge. The hinge thus forms a spacing element at the same time, with which the ring is kept at a spacing from the rear face of the brooch. The ring is provided with a slit diametrically opposite the pivot joint. In addition, diametrically opposite the pivot joint on the rear face of the brooch is arranged a projection which is provided with depressions on its side, into which the ends of this ring, which border on the slit of the ring, engage when the fastening device is closed. A safety member engaging over the ring in its fastened position is provided for safety on this.

The necklace is provided at its ends with spherical or pearl-shaped end members, which are provided with cross bores with which these end members may be pushed on to the pivotal ring through the slit.

Such a fastening device is complicated in its construction and requires specially formed end members for the chain.

SUMMARY OF THE INVENTION

The present invention seeks to provide an improved fastening device.

According to the present invention, there is provided a fastening device for an item of jewellery, said fastening device comprising two rings rigidly connected together by means of at least one spacing element whereby they lie parallel to each other at a spacing, a first of said rings being provided with a slit located adjacent to said spacing element, and a connecting element being fixedly attached to said device.

BRIEF DESCRIPTION OF THE DRAWINGS

Preferred embodiments of the present invention will now be described, by way of example only, with reference to the accompanying drawings, of which.

DESCRIPTION OF THE PREFERRED EMBODIMENTS

Basically the present invention provides a fastening device for an item of jewellery having a bead-shaped end member, the fastening device comprising two rings rigidly connected together by means of at least one spacing element so that they lie parallel to each other at a spacing, one of the rings being provided with a slit located adjacent to the spacing element, and a connecting element being fixedly attached to the device.

In a preferred device, a wire curved according to the curvature of the rings is arranged as the spacing element between the rings, said wire extending over an angle of between about 15° and 120°.

In preferred devices an eyelet is provided as the attached connection element.

In preferred devices at least one further pair of metal rings is provided as the attached connection element. One of the metal rings of the further pair of metal rings transverse to its profile may be provided in an area bordering the spacing element with a slit for hooking on a bead-shaped end member of the chain.

In preferred devices a plate is provided as a spacing element, to which are fixed at least two pairs of rings at a spacing from each other; the plate may be formed as an ornamental plate. At its edge near the pairs of rings, the plate may be formed as a spacing element for the rings; an additional ornamental effect may be achieved by this. The plate may be continuous or perforated.

In preferred devices one of the unslitted rings of a ring pair is provided with a curved cover.

In preferred devices one of the two metal rings on the side facing the other metal ring is provided with a projection projecting over a limited height into the intermediate space between the two metal rings, said projection being arranged near the slit.

In preferred devices a chain end member is provided, which has two beads which are rigidly connected together by means of a tube and the separation of which corresponds substantially to the spacing of the two metal rings.

The rings may have a geometrically defined form.

However, it is also possible for rings to have any desired shape.

Connected pairs of rings may have different sizes.

Figure 1:
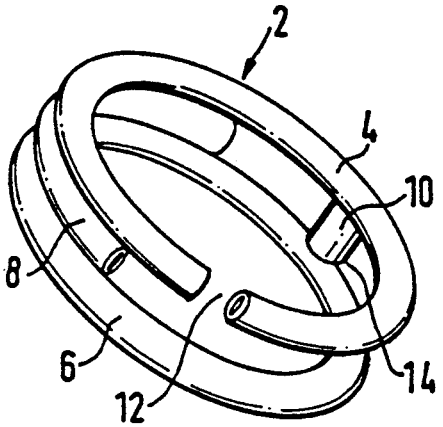
FIG. 1 shows in perspective view the basic element of a fastening device in accordance with the invention

The basic element shown in FIG. 1 of a metallic fastening device in accordance with the present invention comprises a pair of rings 2 with two rings 4,6, which are circular and comprise a profile wire which may be a round wire for example. However, any other desired cross sections are also possible, for example polyhedra cross sections, oval or elliptical cross sections, and the wires may be solid or hollow.

Figure 2:
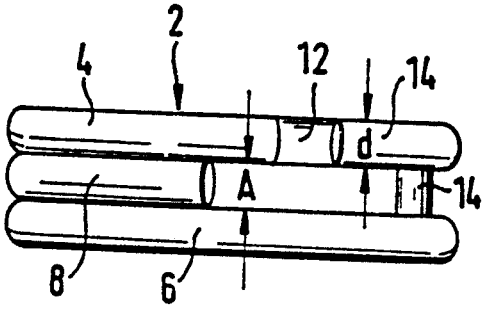
FIG. 2 shows a side view of the element of FIG. 1.

The two rings 4 and 6 lie parallel to each other at a spacing A, which, in the embodiment shown, as may be seen from FIG. 2, corresponds approximately to the diameter of the profile wire, from which the two rings are manufactured. They are substantially congruent in plan view, that is in FIG. 2 as seen from above. In this embodiment they have the same diameter and the same thickness of the profile wire.

The two parallel rings 4 and 6 are connected by means of a spacing element 8. The spacing element 8 is a curved portion of the same profile wire as the rings 4 and 6, said wire being formed as an annular portion with the same radius of curvature as the two rings and being soldered between the two rings. This portion which serves as a spacing element and as a connection between the two rings 4 and 6 extends over an angled area which may be between 15° and 120°.

The spacing element 10, also shown in FIGS. 1 and 2, is a portion of wire which is soldered between rings 4 and 6 with its axis perpendicular to the plane of the rings 4 and 6. Said spacing element 10 may be provided in addition to the spacing element 8. As is readily apparent, a plurality of spacing elements corresponding to the spacing element 10 may also be provided between the rings, in order to connect them firmly at the predetermined spacing.

One of the rings, the ring 4 here, is provided with a radial slit 12 which may have a width of the order of magnitude of 1 to 2 mm. The slit 12 is close to a spacing element, here the end of the spacing element 8. Thus a hook-shaped free portion 14 is formed which extends over at least 90°.

In the region of the spacing element 8 bordering the slit 12 a connection element, which may have different forms, is attached to the described basic element 2.

Figure 3:
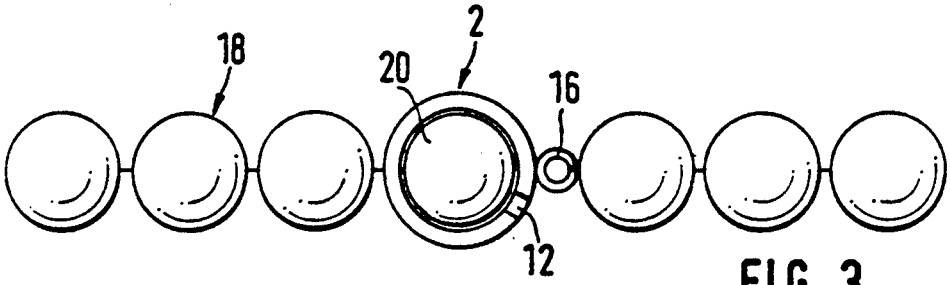
FIG. 3 shows a fastening device with an attached eyelet in connection with a chain of beads.

In FIG. 3 a fastening device is shown in which an eyelet 16 is added on to the pair of rings 2, the eyelet being axially parallel to the two rings. The chain of beads 18, which is shown schematically, is joined on to this eyelet 16 by means of a knot at one end of the draw thread of the chain. The chain is a chain of beads threaded in known manner with intermediate knots. The end of the chain opposite the end knotted to the eyelet is hooked with the end bead 20 into the fastening device. The end bead 20 is placed into the space which is encompassed by the two rings. The thread of the chain between the end bead and the next bead is thus inserted through the slit 12 into the intermediate space between the two rings. The end member of the chain, here the end bead 20, is therefore not permanently connected to a closure member, but is simply hooked into the fastening device.

The eyelet 22 may also be rotated by 90° as compared to the eyelet 16 of the embodiment of FIG. 3.

Figure 4:
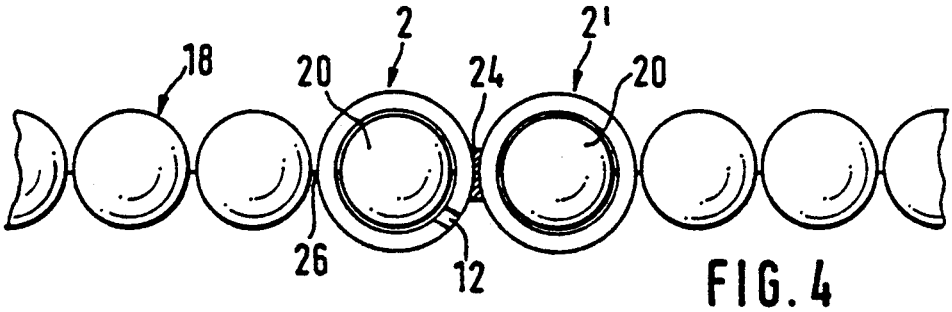
FIG. 4 shows a fastening device with two connected basic elements as shown in FIGS. 1 and 2.

In the embodiment according to FIG. 4, two pairs 2 of parallel rings are firmly connected together, for example by means of soldering 24. The two slits 12 are formed on rings in different planes. The slit is therefore formed in the left-hand pair of rings in the upper ring and in the right hand pair of rings in the lower ring. The two slits border on the connection area, so that the slitted ring in each case forms a hook-shaped area which is larger than 120° between the slit and the passage of the chain thread 26 between the two rings in use of the chain. A very stable formation of the mounting of the end beads is achieved by the opposing arrangement of the slits 12. The chain may be hooked with its two end beads into the fastening device.

In contrast with the view of to FIG. 4 the two pairs 2, 2' of rings, which are connected by means of soldering 24, can be made with different diameters.

Figure 5:
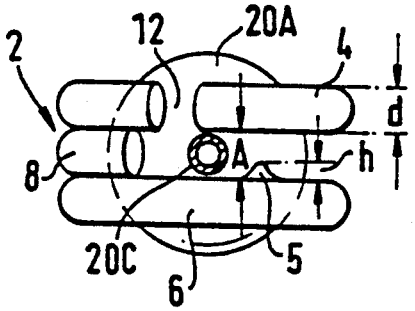
FIG. 5 shows a fastening device similar to FIG. 1 having a stop arrangement.

For high quality chains or necklaces it may be desirable to provide an additional safety arrangement preventing the chain from being released from the fastening device. A fastening device is shown in FIG. 5 with such a safety arrangement. On one of the rings 4,6 a projection 5 is provided at a small spacing from the slit 12 on the side facing the other ring, said projection projecting into the intermediate space between the two rings and thus narrowing this intermediate space by the height h of this projection. The projection thus forms an obstacle for the connection between the end pearl 20 and the adjacent pearl, which has to be overcome if the end pearl is to be released from the fastening device 2. The projection 5 may be soldered on or pressed out of the ring material.

Figure 6:
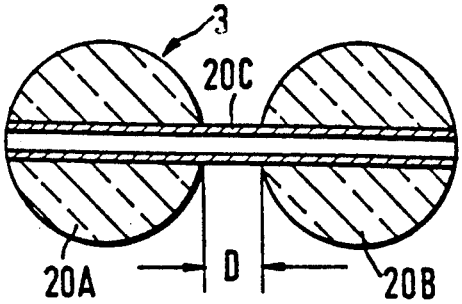
FIG. 6 shows a bead end member with two beads in longitudinal section.

Such a projection may on the other hand lead to increased wear on the chain thread. Therefore it is advisable to provide a special end member 3 for the chain, as is shown in FIG. 6. This end member 3 consists of two pearls or beads 20A, 20B, which are rigidly connected together by a connecting tube 20C. This connecting tube 20C is inserted in bores in the two beads and glued to the beads. The connecting tube may be provided with a screw thread on those portions which engage into the two beads, the connecting tube being capable of insertion into appropriate screw thread bores in the beads. In this rigid end member 3 thus formed the beads have a spacing D which corresponds substantially to the thickness d of the rings 4,6 of the pair of rings. In order to fix this end member, the chain thread is guided through the tube 20C and then fixed; preferably it is glued in the tube 20C.

In order to hook in the fastening device 2, the chain end member 3 is placed with the end bead 20A into the pair of rings 4,6 of the fastening device and the tube 20C is brought between the rings 4,6 through the slit 12. With the second bead 20B the end member 3 is pivoted in the pair of rings and forced over the projection 5 with the tube 20C. During this the slitted ring yields resiliently. In order to release the chain end member 3 the tube 20C has to be forced back over the projection 5, before the chain end member may be released from the fastening device.

In the embodiment shown in FIG. 4, the fastening device 2 may also be permanently connected to one end of the chain 18. The slit 12 in the one pair of rings is then dispensed with. The two rings 4, 6 of this ring pair may thus be bent apart sideways and bent back again after inserting the end bead 20. It is also possible however to place a loose end bead into the ring pair and then pass the thread 26 of the chain into this bead (and thread it on) and to fix it on/in the bead. When using an end member with beads screwed on to the connection tube 20C, as described above in relation to FIG. 6, the end bead may be unscrewed and placed into the unslitted ring pair. The connection tube 20C of the end member 3 is then screwed back into the chain between the two rings and secured if necessary by gluing.

Figure 7:
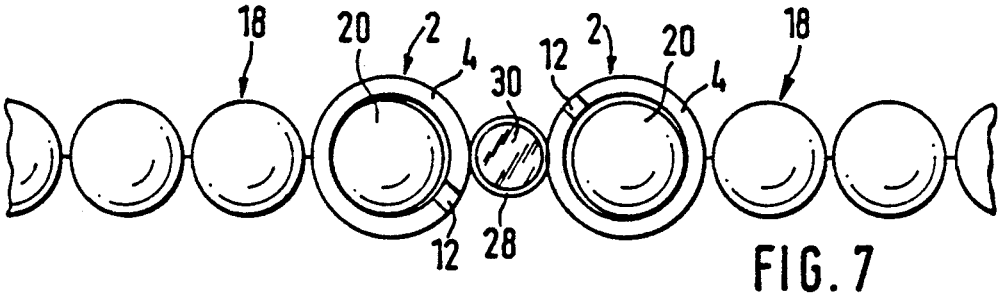
FIG. 7 shows an embodiment similar to FIG. 4, in which the pair of rings are connected together by means of an intermediate element.

In the embodiment shown in FIG. 7, the two ring pairs 2, which are formed with the same diameter, are at a spacing from each other and a ring 28 is provided as the connection element, into which a jewel 30 may be fitted.

Figure 8:
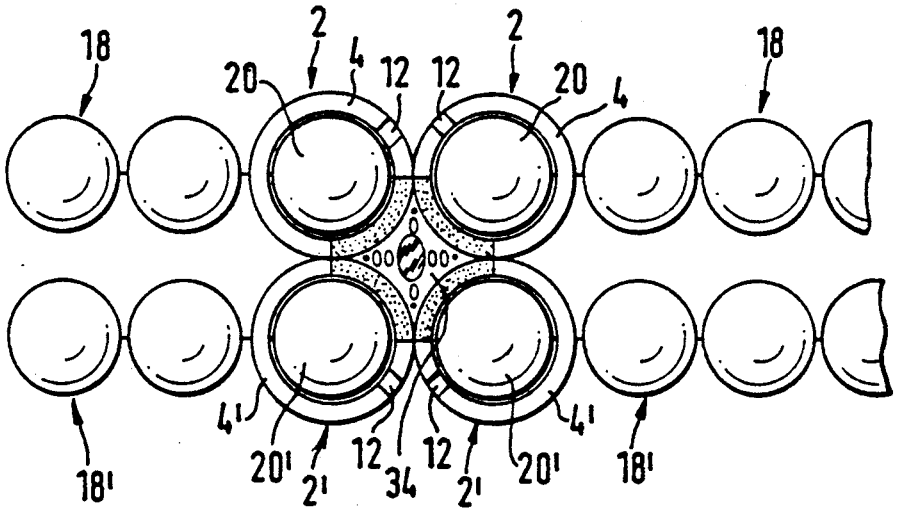
FIG. 8 shows a fastening device as a joint closure element for two chains of beads.

The embodiments described above are fastening devices for single-strand chains. FIG. 8 shows an embodiment for a two-strand chain. Here four ring pairs 2 are connected by means of a plate shaped connecting element 34. The plate 34 may be formed so that it engages with its edge respectively between the rings of the four ring pairs and thus acts as a spacing element for the rings. The rings are soldered to this plate. The plate itself may be decorative, and jewels for example may be set into the plate. The end beads 20,20' of two chain strands 18, 18' are hooked into the ring pairs 2. The fastening device according to FIG. 8 may also be used with a single chain strand. Thus the end beads 20 may be hooked for example into diametrically opposite ring pairs 2.

In the embodiment of FIG. 8 too, one of the end beads of the two chain strands 18,18' may be connected to one of the ring pairs non-releasably as described above.

Figure 9:
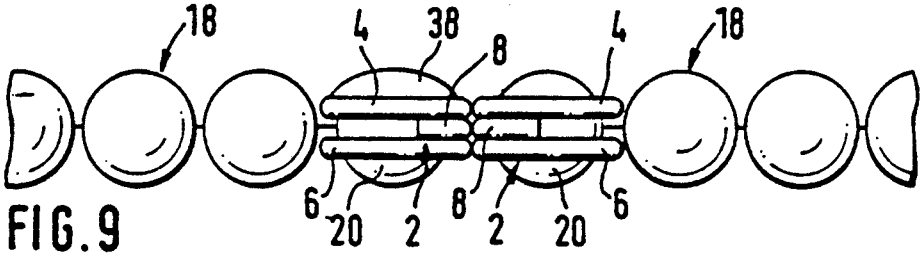
FIG. 9 shows a fastening device similar to FIG. 4 having a curved cover on one of the two pairs of rings.

The embodiment shown in FIG. 9 corresponds basically to that of FIG. 4. In contrast here the unslitted ring 6 of the left-hand ring pair 2 shown is provided with a curved cover 38 which may be continuous or of perforated or filigree form. Such a cover 38 of the unslitted ring may be provided for both ring pairs.

The special advantage of the described fastening device consists in that chains of beads in the form available commercially as an unfinished chain without a fastener may be acquired and completed enhanced with the fastening device in accordance with the invention, which may be formed readily as a decorative jewellery component. The chains may be hooked into the fastening device easily with their end bead, and by virtue of the end bead lying within the ring pair, great safety is given against the chain becoming unhooked from the fastening device unintentionally.

The chain components, as shown in FIG. 4, may be used to connect two or more short chain strands to form a long chain. At the same time they form an ornamental component. In addition, at any desired point of a chain of beads strung with intermediate knots, a ring pair of a chain of beads may be connected with both the thread portions bordering on the beads extending into the intermediate space. Then, a pendant or the like, provided with a bead shaped end member, may be attached to the other ring pair. The same is true for the other arrangements with two ring pairs.

It will be understood that the above description of the present invention is susceptible to various modifications, changes and adaptations.

What is claimed is:

1. In combination, a fastening device and a jewelry chain, said jewelry chain comprising a main portion and a bead-shaped terminal end member which is attached to said main portion with an intermediate member, said intermediate member having a substantially reduced transverse cross sectional dimension relative to said end member, said fastening device comprising a pair of ring elements and a spacing element, said ring elements each defining a central opening of at least slightly larger diameter than the outer diameter of said end member, said spacing element being received and secured to said ring elements so that said spacing element is operative for rigidly maintaining said ring elements in spaced, substantially parallel, aligned relation and so that said spacing element is interposed between said ring elements without significantly obstructing the central openings defined by said ring elements, one of said ring elements having a slit formed therein adjacent said spacing element for receiving said intermediate member therethrough in order to position the latter between said ring elements so that said end member is received in the openings thereby defined, and connecting means for connecting said ring elements and said spacing element to said jewelry chain at a location remote from said end element.

2. In a fastening device according to claim 1, said spacing element comprising a wire, said wire being curved to have the same radius of curvature as said rings, said wire being arranged between said rings, and said wire extending over an angle of between approximately 15° and 120°.

3. A fastening device according to claim 1, wherein said connecting means comprises an eyelet.

4. A fastening device according to claim 1, wherein said connecting means comprises at least one further pair of rings.

5. A fastening device according to claim 4, wherein one of the rings of said further pair of rings is provided with a spacing element, and adjacent to its spacing element with a slit for hooking in a bead-shaped end member of a chain.

6. A fastening device according to claim 4, wherein a plate is provided as said spacing element, at least two of said pairs of rings being fixed thereto at a spacing from each other.

7. A fastening device according to claim 6, wherein said plate is formed at its edge in the area of the ring pairs as a spacing element for the rings.

8. A fastening device according to claim 4, wherein at least one of the rings of one of said ring pairs is unslitted and provided with a curved cover.

9. A fastening device according to claim 1, wherein one of the two rings of said pair on the side facing the other metal ring of said pair is provided with a projection, said projection projecting over a limited height into an intermediate space between said two rings, said projection being arranged adjacent to said slit.

10. A combination of a jewelry chain and a fastening device according to claim 1, wherein said chain comprises a pair of said bead-shaped terminal end members rigidly connected together by means of said intermediate member, said intermediate member being of tubular configuration, the separation between said terminal end members corresponding substantially to the spacing between said two metal rings.

* * * * *